US007091161B2

(12) United States Patent
Oldiges, Jr. et al.

(10) Patent No.: US 7,091,161 B2
(45) Date of Patent: Aug. 15, 2006

(54) NON-METALLIC THREAD SEALANT AND ANTI-SEIZE COMPOUND HAVING IMPROVED ANTI-GALLING PROPERTIES FOR METAL ALLOYS

(75) Inventors: Donald A. Oldiges, Jr., Crypress, TX (US); Herschel McDonald, Red Oak, TX (US); Tom Blake, Spring, TX (US); Kevin Stroup, Spring, TX (US); Don A. Oldiges, III, Crypress, TX (US)

(73) Assignee: Jet-Lube, Inc., Houston, TX (US)

( * ) Notice: Subject to any disclaimer, the term of this patent is extended or adjusted under 35 U.S.C. 154(b) by 481 days.

(21) Appl. No.: 10/438,301

(22) Filed: May 14, 2003

(65) Prior Publication Data

US 2004/0229760 A1 Nov. 18, 2004

(51) Int. Cl.
*C10M 169/06* (2006.01)
*C10M 125/00* (2006.01)

(52) U.S. Cl. ..... 508/154; 508/113; 508/116; 508/129; 508/130; 508/156; 508/165; 508/175; 508/181; 508/219; 508/390

(58) Field of Classification Search ..... 508/154, 508/165, 175, 156, 390
See application file for complete search history.

(56) References Cited

U.S. PATENT DOCUMENTS

| | | | | | |
|---|---|---|---|---|---|
| 3,652,414 | A * | 3/1972 | Bergeron | ..... | 508/119 |
| 5,015,401 | A * | 5/1991 | Landry et al. | ..... | 508/169 |
| 5,093,015 | A * | 3/1992 | Oldiges | ..... | 508/124 |
| 5,154,840 | A * | 10/1992 | Drake et al. | ..... | 508/122 |
| 5,286,393 | A * | 2/1994 | Oldiges et al. | ..... | 508/139 |
| 5,348,668 | A * | 9/1994 | Oldiges et al. | ..... | 508/139 |
| 5,498,351 | A * | 3/1996 | Hefling | ..... | 508/111 |
| 5,536,422 | A * | 7/1996 | Oldiges et al. | ..... | 508/121 |
| 5,547,503 | A * | 8/1996 | Oldiges et al. | ..... | 106/287.18 |
| 5,891,830 | A * | 4/1999 | Koltermann et al. | ..... | 508/136 |
| 6,620,460 | B1 * | 9/2003 | Oldiges et al. | ..... | 427/409 |
| 6,960,555 | B1 * | 11/2005 | Anthony et al. | ..... | 508/136 |

* cited by examiner

*Primary Examiner*—Ellen M. McAvoy
(74) *Attorney, Agent, or Firm*—Robert W. Strozier

(57) ABSTRACT

An anti-seize compound is disclosed for use on surfaces of threaded connections made of speciality alloys such as high nickel or chrome ferrous alloys or other speciality alloys prone to galling under high stress conditions. The compound using a metal fluoride as the anti-seize film forming agent at least above about 5 wt %.

25 Claims, No Drawings

NON-METALLIC THREAD SEALANT AND ANTI-SEIZE COMPOUND HAVING IMPROVED ANTI-GALLING PROPERTIES FOR METAL ALLOYS

BACKGROUND OF THE INVENTION

1. Field of the Invention

The present invention relates to a non-metallic thread sealant and anti-seize compound for use on high nickel or chrome containing ferrous alloys or other metal alloys prone to galling under high contact stress.

More particularly, the present invention relates to a non-metallic thread sealant and anti-seize compound for use on high nickel or chrome containing ferrous alloys or other metal alloys prone to galling under high contact stress including one or more thixotropic or rheopectic base materials, one or more anti-seize agents, and one or more boundary lubricant.

2. Description of the Related Art

High chrome and/or high nickel alloy threaded connections for applications incurring high contact stress such as oilfield premium tubing and casing and MWD (monitor while drilling) tools have been found to adversely perform in the presence of a high concentration of graphite fillers and PTFE. Natural, synthetic and even fiber graphite materials result in a greater propensity for galling under high rotational loading such as in threaded connections, unless a large weight percent of soft metal additives are present such as lead, zinc and copper (API 5A3 reference compound). Prior art anti-seize compounds are disclosed in U.S. Pat. Nos.: 5,093,015; 5,536,422; 3,652,414; and 3,652,415.

Thus, there is a need for a sealant and/or anti-seize compound with improved sealant and anti-seize properties for threaded connections made of alloys prone to galling under high contact stress having less than about 10% by volume percentages of graphitic types materials or other fibrous organic materials such as PTFE.

SUMMARY OF THE INVENTION

The present invention provides an anti-seize thread composition including one or more thixotropic base material, one or more boundary lubricants, and one or more anti-seize agents. The anti-seize compound of the present invention preferably further includes an anti-wear additive and/or other additive systems. The anti-seize agents form an anti-seize film on the surfaces of threaded connections made of specialty alloys having sufficient film strength to protect the surfaces from galling under high stress.

The present invention also provides a sealant/anti-seize thread composition including one or more thixotropic base materials, one or more boundary lubricants, and one or more anti-seize, particulate, metal fluorides. The anti-seize compound of the present invention preferably further includes an anti-wear additive and/or other additive systems.

The present invention also provides a sealant/anti-seize thread composition including one or more thixotropic base materials, one or more boundary lubricants, one or more anti-seize, particulate, metal fluorides, an anti-wear additive system and an anti-degradant additive system.

The present invention also provides a sealant/anti-seize thread compound including one or more thixotropic base materials, one or more boundary lubricants, one or more anti-seize, particulate, metal fluorides, an anti-wear additive system and an anti-degradant additive system, where the metal fluorides are selected from the group consisting of lithium fluoride (LiF), sodium fluoride (NaF), potassium fluoride (KF), rubidium fluoride (RbF), cesium fluoride (CsF), magnesium fluoride ($MgF_2$), calcium fluoride ($CaF_2$), strontium fluoride ($SrF_2$), yttrium fluoride ($YF_3$), lanthanum fluoride ($LaF_3$), cerium fluoride ($CeF_3$), neodymium fluoride ($NdF_3$), europium fluoride ($EuF_3$), dysprosium fluoride ($DyF_3$), or mixtures or combinations thereof. Preferred non-corrosive metal fluorides include sodium fluoride (NaF), potassium fluoride (KF), rubidium fluoride (RbF), cesium fluoride (CsF), magnesium fluoride ($MgF_2$), calcium fluoride ($CaF_2$), cerium fluoride ($CeF_3$) or mixtures or combinations thereof.

The present invention also provides a sealant/anti-seize thread composition including one or more thixotropic base materials, one or more boundary lubricants, one or more anti-seize, particulate, metal fluorides, an anti-wear additive system and an anti-degradant additive system, where the metal fluorides are selected from the group consisting of lithium fluoride (LiF), sodium fluoride (NaF), potassium fluoride (KF), rubidium fluoride (RbF), cesium fluoride (CsF), magnesium fluoride ($MgF_2$), calcium fluoride ($CaF_2$), strontium fluoride ($SrF_2$), yttrium fluoride ($YF_3$), lanthanum fluoride ($LaF_3$), cerium fluoride ($CeF_3$), neodymium fluoride ($NdF_3$), europium fluoride ($EuF_3$), dysprosium fluoride ($DyF_3$), or mixtures or combinations thereof. Preferred non-corrosive metal fluorides include sodium fluoride (NaF), potassium fluoride (KF), rubidium fluoride (RbF), cesium fluoride (CsF), magnesium fluoride ($MgF_2$), calcium fluoride ($CaF_2$), cerium fluoride ($CeF_3$) and mixtures or combinations thereof and where the boundary lubricants are selected from the group consisting of metal borates, metal molybdates, metal carbonates, metal acetates, and mixture or combinations thereof.

The present invention also provides a sealant/anti-seize thread composition including one or more thixotropic base materials, one or more boundary lubricants, one or more anti-seize, particulate, metal fluorides, an anti-wear additive system and an anti-degradant additive system, where the thixotropic base material comprises a fluid thickened by a suspending agent and where the metal fluorides are selected from the group consisting of lithium fluoride (LiF), sodium fluoride (NaF), potassium fluoride (KF), rubidium fluoride (RbF), cesium fluoride (CsF), magnesium fluoride ($MgF_2$), calcium fluoride ($CaF_2$), strontium fluoride ($SrF_2$), yttrium fluoride ($YF_3$), lanthanum fluoride ($LaF_3$), cerium fluoride ($CeF_3$), neodymium fluoride ($NdF_3$), europium fluoride ($EuF_3$), dysprosium fluoride ($DyF_3$), or mixtures or combinations thereof. Preferred non-corrosive metal fluorides include sodium fluoride (NaF), potassium fluoride (KF), rubidium fluoride (RbF), cesium fluoride (CsF), magnesium fluoride ($MgF_2$), calcium fluoride ($CaF_2$), cerium fluoride ($CeF_3$) and mixtures or combinations thereof and where the boundary lubricants are selected from the group consisting of graphitic materials, fluorine-containing polymers, natural or synthetic fibers, $MoS_2$, and mixture or combinations thereof and where the thixotropic base material selected from the group consisting of a lithium complex grease, an aluminum complex grease, a calcium complex grease and mixtures or combinations thereof, and other additives selected from the group consisting of graphite, PTFE, fibers, $MoS_2$, and mixture or combinations thereof.

The present invention also provides a method for preparing the anti-seize thread composition including the steps of dispersing in a thixotropic base material an anti-seize system, a boundary lubricant system, optionally a friction adjustment system, optionally an anti-wear system and optionally an anti-degradant system.

The present invention also provides a method for using an anti-seize thread composition of this invention including the steps of applying an a mount of an anti-seize composition of this invention to surfaces of an alloy threaded connection, prior to making-up of the connection, sufficient to form an anti-seize protection film on the surfaces of the alloy threaded connection, where the film protects the alloy threaded connection from galling, marring and/or seizing during make-up and break-out of the alloy connections are made-up or engaged to specified requirements. After application of the composition to the surfaces of the alloy threaded connection, making-up the alloy threaded connection. The method can also include the steps of applying additional anti-seize composition to the surfaces of the alloy threaded connection after each break-out, or prior to next make-up.

DETAILED DESCRIPTION OF THE INVENTION

The inventors have found that a nonmetallic thread sealant and anti-seize compound or composition for use on high nickel or chrome containing ferrous alloys or other metal alloys prone to galling under high contact stress can be formulated.

The composition of this invention broadly includes a thixotropic or rheopectic base material such as a metal salt complex grease, a metal fluoride anti-seize agent, a boundary lubricants such as calcium salts such as borates, molybdates, carbonates, acetates, stearate, etc. The composition can also include lesser amounts of graphite materials, molybdenum disulfide, polymer fibers, and PTFE to provide controlled frictional properties and enhance sealability where required in specific thread form designs. The composition can also include polymers for adhesion improvement, rust and corrosion resistance and antioxidants. The composition can also include organic extreme pressure and anti-wear additives, but such additives can reduce the anti-galling protection if not properly selected and utilized at relatively low amounts generally less than about 15 wt. %.

The new compound is particularly well-suited for use in oil, mining or water well drilling operations or in industrial applications where speciality alloys such as high nickel and chrome ferrous alloys or other metal alloys prone to galling under high contact stress are used.

Suitable anti-seize agents include, without limitations, metal fluorides or mixtures of non-metal fluorides. Exemplary metal fluorides include lithium fluoride (LiF), sodium fluoride (NaF), potassium fluoride (KF), rubidium fluoride (RbF), cesium fluoride (CsF), magnesium fluoride ($MgF_2$), calcium fluoride ($CaF_2$), strontium fluoride ($SrF_2$), yttrium fluoride ($YF_3$), lanthanum fluoride ($LaF_3$), cerium fluoride ($CeF_3$), neodymium fluoride ($NdF_3$), europium fluoride ($EuF_3$), dysprosium fluoride ($DyF_3$), or mixtures or combinations thereof. Preferred metal fluorides include sodium fluoride (NaF), potassium fluoride (KF), rubidium fluoride (RbF), cesium fluoride (CsF), magnesium fluoride ($MgF_2$), calcium fluoride ($CaF_2$), cerium fluoride ($CeF_3$) or mixtures or combinations thereof. Particularly preferred metal fluorides include sodium fluoride (NaF), potassium fluoride (KF), rubidium fluoride (RbF), cesium fluoride (CsF), calcium fluoride ($CaF_2$), cerium fluoride ($CeF_3$) or mixtures or combinations thereof. Especially preferred non-corrosive metal fluorides include magnesium fluoride ($MgF_2$), calcium fluoride ($CaF_2$), cerium fluoride ($CeF_3$) or mixtures or combinations thereof. Most preferred metal fluoride is calcium fluoride ($CaF_2$). Of course, it should be recognized that the meaning of non-metallic is directed at the fact that the anti-seize composition contains no zero valent metals, i.e., metals in their pure metallic state.

The thixotropic base material useful in the compounds of the present invention include any material that may be used to uniformly suspend the other components of the thread compounds of the present invention and the exact nature of the thixotropic base material is not thought to be critical to the film forming and ant-seize properties of the present thread compounds. Suitable thixotropic base materials of the present invention comprise one or more fluids and one or more thickening agents such as a lithium complex, an aluminum complex and/or a calcium complex. The examples provided indicating the grease also include the practice of using a grease concentrate with additional oil added to attain a desired consistency.

Suitable fluids include, without limitation, synthetic (man-made) fluids, petroleum based fluids (derived from crude oil via refining), natural fluids and mixtures thereof. The fluids of preference for use in the thread compounds of the present invention have viscosities ranging from about 5 to about 600 centistokes at 40° C. Preferred fluids include, without limitation, polyalphaolefins, polybutenes, polyolesters, vegetable oils, animal oils, other essential oil, and mixtures thereof.

Suitable polyalphaolefins (PAOs) include, without limitation, polyethylenes, polypropylenes, polybutenes, polypentenes, polyhexenes, polyheptenes, higher PAOs, copolymers thereof, and mixtures thereof. Preferred PAOs include PAOs sold by ExxonMobil Chemical Company as SHF fluids and PAOs sold by BP-Amoco Chemical under the name Durasyn. Such fluids include those specified as ETYHLFLO 162, 164, 166, 168, 170, 174, and 180. Particularly preferred PAOs include bends of about 56% Durasyn 174 and about 44% of Durasyn 168.

Preferred polybutenes include, without limitation, those sold by BP Amoco Chemical Company and ExxonMobil Chemical Company under the trade names INDOPOL and PARAPOL, respectively. Particularly preferred polybutenes include BP Amoco's INDOPOL 100.

Preferred polyolester include, without limitation, neopentyl glycols, trimethylolpropanes, pentaerythriols, dipentaerythritols, and diesters such as dioctylsebacate (DOS), diactylazelate (DOZ), and dioctyladipate.

Preferred petroleum based fluids include, without limitation, white mineral oils, paraffinic oils, and medium-viscosity-index (MVI) naphthenic oils having viscosities ranging from about 5 to about 600 centistokes at 40° C. Preferred white mineral oils include those sold by Crompton Chemical Corporation, Citgo, Lyondell Chemical Company, PSI, and Penreco. Preferred paraffinic oils include solvent neutral oils available from ExxonMobil Chemical Company, high-viscosity-index (HVI) neutral oils available from Shell Chemical Company, and solvent treated neutral oils available from Arco Chemical Company. Preferred MVI naphthenic oils include solvent extracted coastal pale oils available from ExxonMobil Chemical Company and Ergon, MVI extracted/acid treated oils available from Shell Chemical Company, and naphthenic oils sold under the names HydroCal and Calsol by Calumet. The newer Group 2 and Group 3 oils can also use used in the compositions of this invention.

Preferred vegetable oils include, without limitation, castor oils, corn oil, olive oil, sunflower oil, sesame oil, peanut oil, other vegetable oils, modified vegetable oils such as crosslinked castor oils and the like, and mixtures thereof. Preferred animal oils include, without limitation, tallow, mink oil, lard, other animal oils, and mixtures thereof. Other essential oils will work as well. Of course, mixtures of all the above identified oils can be used as well.

Suitable suspending agents include, without limitation, suspending agents conventionally used in paints and thread compound such as silica, clay, organic thickeners, or mixtures thereof. Suitable organic thickeners can include, without limitation, metal or mineral soaps or complex soaps, polyureas, other polymers, and mixtures thereof. Preferred soaps or soap complexes include aluminum benzoate-stearate complexes, aluminum benzoate-behenate-arachidate complexes, lithium azelate-stearate complexes, lithium sebecate-stearate or behenate complexes, lithium adipate-stearate complexes, calcium acetate-stearate complexes, calcium sulfonate-stearate complexes, but other aluminum, calcium, lithium, or other mineral soaps or complex soaps and mixtures thereof can equally well be used.

Preferred organic thickener thixotropic base materials include, without limitation, one or more metallic or mineral soap or soap complex thickened hydrocarbon fluids. Aluminum, calcium, lithium complex greases or mixtures thereof are particularly preferred as they generally have high melt points and excellent water resistance.

Generally, organic thickener thixotropic base materials comprise from about 2 wt. % to about 15 wt. % of one or more soaps and/or soap complexes and from about 98 wt. % to about 85 wt. % of one or more oils as described below. The preferred requirement for the thixotropic base material is that material has a sufficient viscosity to yield a final base oil viscosity in the range of about 20 to about 250 centistokes at 40° C. Of course, the final composition viscosity for the thixotropic base will depend on the amount of the base used in the formulation, the viscosity of the other ingredients, and on the thickening tendencies of the solid materials. However, in general, because the thixotropic base comprises the majority of the composition, the viscosity will be more or less controlled by the viscosity of the thixotropic base material.

Water resistance is particularly important in oilfield, mining or water well drilling operations. Aluminum complex and calcium sulfonate complex thickened hydrocarbon fluids are particularly preferred as they generally have a high melt point, wet metal adhesion, superior water resistance and can be formulated to conform to food grade requirements so are classified as nonhazardous.

The boundary lubricants suitable for use in the present invention include, without limitation, graphites, graphitic type materials, calcium compounds such as borates, carbonates, sulfates, acetates, etc., other nonabrasive mineral compounds such as silicates, other metal acetates, other metal carbonates, other metal sulfates, etc., or mixtures thereof.

The finely divided fibers suitable for use in the present invention include, without limitation, synthetic polymeric fibers, non-abrasive mineral fibers, natural fibers, and mixtures thereof. Suitable synthetic polymeric fibers include, without limitation: polyamides such as nylon, kevlarTM, aramid, and the like; polyimides; polyesters such as PET and the like, polycarbonates, phenolics, carbon and carboneous, and the like and mixtures thereof Suitable natural fibers include cellulose such as cotton and the like, modified cellulose and the like and mixtures thereof Suitable mineral fibers include, without limitation, silicaceous mineral fibers and the like.

The fibers are thought to interlock under shear to produce a boundary lubricant retaining film on the surface of the threaded connections. This film is thought to result in a thread compound with improved galling and seize resistance.

The present invention can preferably further includes an anti-wear additive system. Suitable anti-wear additives include, without limitation, molybdenum disulfide, boron nitride, bismuth naphthenate, organic sulfur additives, and mixtures thereof.

The present invention may further contain other conventional additives such as rust inhibitors, antioxidants, and corrosion inhibitors. These additional additives can be blended into the thixotropic base material prior to compound preparation or added during compound preparation. Such additives are added to the thixotropic base materials or to final compositions using mixing procedures well-known in the art.

The composition of this invention generally form an anti-seize films on the surface of connections, such as threaded connections, the films generally must be thick enough to provide adequate anti-galling, anti-marring and anti-seize properties the to speciality alloys connections; however, not so thick as to interfere with the standard functioning of the connections, i.e., interfere with make-up and break out of the connections. Preferably, the film thickness is between about 0.1 mils and about 2 mils (about 0.0001 inches to about 0.002 inches, about 0.000254 cm to about 0.00508 cm), and particularly, between about 0.5 mils and about 2 mils (about 0.0005 inches to about 0.002 inches, about 0.00127 cm to about 0.00508 cm), and more particularly, between about 1 mil and about 1.5 mils (about 0.001 inches to about 0.0015 inches, about 0.00254 cm to about 0.00381 cm).

The anti-seize composition of the present invention may be prepared by blending the ingredients together using mixing procedures well-known in the art. The components must be substantially homogeneously blended to provide optimum film integrity. For smaller quantities, blending may take place in a pot or drum. For large quantities, the composition may be blended by combining the components in a large kettle mixer and mixing them together to produce a substantially homogeneous blend.

The compositions of this invention can include the ingredients, their corresponding amount ranges and non-inclusive, exemplary ingredients examples are listed in the table below:

TABLE 1

| | | Formulation Index | |
|---|---|---|---|
| Ingredient | Sub-Ingredients | Amount (wt. %) | Exemplary Examples |
| Thixotropic base material | | about 40 to about 90 | metal salt complex greases |
| metal complex | | about 50 to | lithium complex grease, aluminum |

TABLE 1-continued

| Formulation Index | | | |
|---|---|---|---|
| Ingredient | Sub-Ingredients | Amount (wt. %) | Exemplary Examples |
| grease | | about 90 | complex grease, calcium complex grease |
| | base oil | about 98 to about 85 | petroleum oils, synthetic oils, natural oils |
| | thickening metal salts | about 2 to about 15 | lithium, oxide, hydroxide, carbonate, sulfonate, etc.; aluminum oxide, hydroxide, carbonate, sulfonate, etc.; calcium oxide, hydroxide carbonate, sulfonate, etc. |
| anti-seize agents | metal fluorides | about 5 to about 50 | LiF, NaF, KF, RbF, CsF, $MgF_2$, $CaF_2$, $SrF_2$, $YF_3$, $LaF_3$, $CeF_3$, $NdF_3$, $EuF_3$, $DyF_3$, or mixtures thereof |
| boundary lubricant | metal salts | about 5 to about 40 | metal borates, molybdates, carbonates, acetates, stearates, etc. |
| friction adjusters | polymers, powders and fibers | up to about 12 | PTFE, graphitic materials, natural or synthetic fibers, molybdenum disulfide, etc. |
| anti-wear additives | | up to about 5 | Sulfurized isobutylene, phosphate esters, dithiocarbamates, dithiophosphates, naphthanates, or the like |
| anti-degradant additives | | up to about 2 | anti-oxidants and anti-ozonants |
| Specialty additives | | Depend on formulation | Tackifiers, $H_2S$ Inhibitor, dyes or pigments |

The present thread compounds can preferably include from about 40% to about 80% by weight of a thixotropic base material, from about 5% to about 40% by weight of one or more boundary lubricants and about 5% to about 50% by weight of one or more metal fluorides. Additionally, the thread compounds of the present invention can include up to about 12% by weight of an anti-wear additive system and up to about 5% by weight of an anti-degradant system. The anti-degradant system can include an antioxidant, an rust inhibitor, and/or corrosion inhibitor.

More particularly, the present thread compounds can include from about 50% to about 80% by weight of a thixotropic base material, from about 10% to about 30% by weight of one or more boundary lubricants, and from about 5% to about 40% by weight of one or more metal fluorides. Again, the present invention can include up to about 10% by weight an anti-wear additive system and up to about 4% by weight of an anti-degradant system.

More especially, the present thread compounds can include from about 60% to about 80% by weight of a thixotropic base material, from about 15% to about 25% by weight of one or more boundary lubricants, and from about 5% to about 30% by weight of one or more metal fluorides. Again, the present invention can include up to about 8% by weight an anti-wear additive system and up to about 3% by weight of an anti-degradant system.

If non-metallic, finely divided fiber, which is generally available in a pulp form, are included in the compositions of this invention, then it is important to insure that the fibers are adequately dispersed in the compound. The necessity for adequate dispersion of the fiber normally requires that the fiber be pre-mixed in the thixotropic base material. Thus, the fiber is first broken by hand into small clumps and then mixed into the thixotropic base material in premix step. When mixing is done in a conventional vertical blender, about 4 wt. % of fiber is mixed with 96 wt. % of the thixotropic base material. The mixing is performed as a moderate mix speed of about 45 rpm with half of the thixotropic base for about 15 minutes and then at a high speed, usually at the highest practical speed of the mixer, for another at least 15 minutes. The pre-mix is then tested for fiber dispersion. If no visible clumps are seen, then the remaining half of the thixotropic base is added and mixed for another about 15 minutes. The main purpose of this pre-mix step is to ensure that the fiber is substantially and uniformly distributed throughout the final thread compound so that film formation and integrity is optimized. Of course, the pre-mix can also be done in colloidal mixers and other types of apparatus. Additionally, the pre-mix can be pre-strained to remove any non-dispersed fiber.

The fiber containing pre-mix can then be added to the other ingredients in a standard blender, usually vertical. The compound is mixed for at least 30 minutes after ingredient addition to ensure homogeneity. Of course, shorter and longer mixing times can be used depending on the mixer speed and type.

The present invention solved problems associated with currently available anti-seize compounds for threaded connections made of speciality alloys prone to galling under high stress conditions, where large amount of graphitic or other type of anti-wear additives are used requiring the addition of large amount of metal powder or metal flakes. The inventors surprisingly found that fluorides such as calcium fluorides used in large amounts generally greater than about 5 wt. % can obviate these problems and produced superior compositions designed to protect alloys threads under high stress conditions. The examples are illustrative of these compositions and, therefore, should not be construed to limit the scope of the present invention.

EXPERIMENTAL SECTION

Example 1

This example illustrates a preferred anti-seize composition of this invention using a calcium sulfonate complex, thixotropic base material and 30 wt. % calcium fluoride as the anti-seize agent and 9.4 wt. % calcium salts as one of boundary lubricants.

The composition includes the following ingredients and amounts:

| Ingredient | Amount (wt. %) |
|---|---|
| calcium sulfonate complex base grease | 58.10 |
| Calcium Salts | 9.4 |
| Calcium Fluoride | 30.00 |
| Tackifier | 0.40 |
| $H_2S$ Inhibitor | 0.10 |
| Hydrocarbon Fiber | 1.00 |
| Ashless Graphite/Carbon | 1.00 |
| Total | 100.00 |

The calcium salt can be calcium carbonate, acetate, molybdate, sulfonate, borate, stearate, or mixtures thereof.

The composition is generally mixed in a temperature controlled mixer or kettle reactor for a time and at a temperatures sufficient to generate a substantially homogenous composition, where the term substantially homogenous means that the composition does not vary by more the about 5% within the reactor and preferably does not vary by more than about 2%. Moreover, the composition can vary in weight percent of the ingredients by ± about 10%, preferably, ± about 5% and particularly ± about 2.5%.

Example 2

This example illustrates a preferred anti-seize composition of this invention using a calcium sulfonate complex, thixotropic base material and 15 wt. % calcium fluoride as the anti-seize agent and 18 wt. % calcium salts as one of boundary lubricants.

The composition includes the following ingredients and amounts:

| Ingredient | Amount (wt. %) |
|---|---|
| Lithium sulfonate complex base grease | 42.45 |
| Calcium Salts | 28.50 |
| Calcium Fluoride | 15.00 |
| PTFE | 3.50 |
| Tackifier | 0.30 |
| $H_2S$ Inhibitor | 0.10 |
| Aramid Fiber | 0.15 |
| Ashless Graphite/Carbon | 10.00 |
| Total | 100.00 |

The calcium salt can be calcium carbonate, acetate, molybdate, sulfonate, borate, stearate, or mixtures thereof.

The composition is generally mixed in a temperature controlled mixer or kettle reactor for a time and at a temperatures sufficient to generate a substantially homogenous composition, where the term substantially homogenous means that the composition does not vary by more the about 5% within the reactor and preferably does not vary by more than about 2%. Moreover, the composition can vary in weight percent of the ingredients by ± about 10%, preferably, ± about 5% and particularly ± about 2.5%.

Example 3

This example illustrates a preferred anti-seize composition of this invention using a calcium sulfonate complex, thixotropic base material and 5 wt. % calcium fluoride as the anti-seize agent and 18 wt. % calcium salts as one of boundary lubricants.

The composition includes the following ingredients and amounts:

| Ingredient | Amount (wt. %) |
|---|---|
| Metal complex base grease | 56.50 |
| Calcium Salts | 18.00 |
| Calcium Fluoride | 5.00 |
| PTFE | 7.00 |
| Aramide Fiber | 0.50 |
| Graphite | 13.00 |
| Total | 100.00 |

The metal complex base grease can an aluminum complex base grease, a lithium complex base grease, a calcium complex base grease, a lithium 12-hydroxy-stearate grease, a calcium 12-hydroxy-stearate grease, or mixtures thereof.
The calcium salt can be calcium carbonate, acetate, molybdate, sulfonate, borate, stearate, or mixtures thereof.

The composition is generally mixed in a temperature controlled mixer or kettle reactor for a time and at a temperatures sufficient to generate a substantially homogenous composition, where the term substantially homogenous means that the composition does not vary by more the about 5% within the reactor and preferably does not vary by more than about 2%. Moreover, the composition can vary in weight percent of the ingredients by ± about 10%, preferably, ± about 5% and particularly ± about 2.5%.

Example 4

This example illustrates a preferred anti-seize composition of this invention using a calcium sulfonate complex, thixotropic base material and 20 wt. % calcium fluoride as the anti-seize agent and 18 wt. % calcium salts as one of boundary lubricants.

The composition includes the following ingredients and amounts:

| Ingredient | Amount (wt. %) |
|---|---|
| Hydrocarbon Fiber | 1.00 |
| Carbon Black | 0.20 |
| Sulfonate Complex | 51.80 |
| $H_2S$ Inhibitor | 0.10 |
| Calcium Salts | 18.00 |
| PTFE - 5–100 Micron | 3.50 |
| Calcium Fluoride | 20.00 |
| Tackifier | 0.40 |
| Ashless Graphite | 5.00 |
| Total | 100.00 |

The composition is generally mixed in a temperature controlled mixer or kettle reactor for a time and at a temperatures sufficient to generate a substantially homogenous composition, where the term substantially homogenous means that the composition does not vary by more the about 5% within the reactor and preferably does not vary by more than about 2%. Moreover, the composition can vary in weight percent of the ingredients by ± about 10%, preferably, ± about 5% and particularly ± about 2.5%. The composition had a density of 10.4 lbs./gal. and a 309 Penetration.

Example 5

This example illustrates a preferred anti-seize composition of this invention using a calcium sulfonate complex, thixotropic base material and 20 wt. % calcium fluoride as the anti-seize agent and 15 wt. % calcium salts as one of boundary lubricants.

The composition includes the following ingredients and amounts:

| Ingredient | Amount (wt. %) |
|---|---|
| Hydrocarbon Fiber | 1.20 |
| Sulfonate Complex | 53.30 |
| Calcium Salts | 15.00 |
| Calcium Fluoride | 20.00 |
| PTFE - 5 Micron | 3.00 |
| Tackifier | 0.40 |
| $H_2S$ Inhibitor | 0.10 |
| Total | 100.00 |

The composition is generally mixed in a temperature controlled mixer or kettle reactor for a time and at a temperatures sufficient to generate a substantially homogenous composition, where the term substantially homogenous means that the composition does not vary by more the about 5% within the reactor and preferably does not vary by more than about 2%. Moreover, the composition can vary in weight percent of the ingredients by about 10%, preferably, ± about 5% and particularly about 2.5%. The composition had a density of 11.0 lbs./gal and a 314 Penetration.

Examples 4 and 5 represent intermediate formulations with different but intermediate friction coefficients between compositions of Examples 1 and 2. Example 1 provided optimum performance on large diameter casing of the L-80 premium thread design for galling resistance aided by the high coefficient of friction. This allows the connection to be in lower contact stress when engaged using specified torque values. Example 2 provided the best performance on certain high chrome premium connections with respect to galling resistance and frictional properties, but not for L-80 premium thread designs from another OEM thread design. Example 3 provides low friction properties and poor galling resistance on high chrome and L-80 type alloys, and shows a better than a 15% improvement relative to amorphous graphite in lithium grease compositions used as the reference compound. Example 4 provided a high level of galling resistance and frictional properties and performed well on both types of alloys and their OEM premium thread designs. Example 5 provided less galling resistance than Example 4, in spite of having good frictional properties. The aerosol sized PTFE likely results in too many particles per unit volume than the larger particle size distribution. It is known that as more PTFE is added, the composition shows a drop in film strength/galling resistance.

The compositions are generally mixed in a temperature controlled mixer or kettle reactor for a time and at a temperatures sufficient to generate a substantially homogenous composition, where the term substantially homogenous means that the composition does not vary by more the about 5% within the reactor and preferably does not vary by more than about 2%. For compositions including organic fibers such as aramide fibers, the fibers are preferably pre-dispersed in the base grease prior to addition of the other ingredients.

Environmental and occupational health restrictions/legislation are more aggressively restricting or forbidding the use of heavy metal additives. As drilling conditions become more severe, current "green" technology has not produced an acceptable performance based product until this discovery was made. Molybdenum disulfide is also restricted for environmental as well as hydrolytic or galvanic corrosion related concerns.

The discovery that calcium fluoride, when in conjunction with other calcium salts provides enhanced galling resistance in these high chrome and nickel alloys, has allowed the development of a product that is not only environmentally safe, but also provides better galling resistance and lower breakout torques than the conventional API-MODIFIED or API-SILICONE outlined in American Petroleum Institute Bulletin 5A2 and in Appendix A of RP 5A3. These additives can be utilized in any thixotropic or rheopectic grease system such as aluminum, calcium, lithium, barium or sodium. It can also be utilized in polyurea or polyurea complex thickened greases.

TESTING RESULTS FOR NEW COMPOSITIONS

Make-up torque in this type of connection does not provide the primary frictional data to compare relative coefficients of friction using 13% chrome alloy connections with high thread and high seal face interference.

Shoulder torque will be the best measure of the relative frictional difference between the thread compounds. Comparing shoulder torque to API-MODIFIED, the following frictional data differences were observed:

| Composition | Aug Shoulder Torque | Δ to API-MODIFIED |
|---|---|---|
| Graphite Reference | 3896 | 1.524 |
| API-MODIFIED | 2556 | 1.0 |
| EXAMPLE 2 | 2413 | 0.944 |
| EXAMPLE 1 | 3906 | 1.53 |

Comparing breakout to make-up torque data and corresponding immediate ratios and one week breakout to make-up torque data and corresponding ratios gave the following values:

| Composition | Breakout to Make-up | One Week |
|---|---|---|
| API-MODIFIED | 6467/5849 = 1.106 | 10090/5849 = 1.727 |
| EXAMPLE 2 | 6104/5850 = 1.043 | 8965/5850 = 1.531 |
| EXAMPLE 1 | 6801/5850 = 1.163 | *6890/5850 = 1.178 |
| Graphite Reference | 7436/5860 = 1.26 | No Data |

*May not be valid; only one data point.

All references cited herein are incorporated herein by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

We claim:

1. An anti-seize thread composition comprising:

from about 40% to about 80% by weight of a thixotropic base material selected from the group consisting of a lithium complex grease, an aluminum complex grease, a calcium complex grease, and mixtures or combinations thereof, from about 5% to about 40% by weight of one or more boundary lubricants selected from the group consisting of a metal borate, metal acetate, metal carbonate, metal sulfate, and mixtures or combinations thereof, from about 5% to about 50% by weight of one or more metal fluorides selected from the group consisting of lithium fluoride (LiF), sodium fluoride (NaF), potassium fluoride (KF), rubidium fluoride (RbF), cesium fluoride (CsF), magnesium fluoride ($MgF_2$), calcium fluoride ($CaF_2$), strontium fluoride ($SrF_2$), yttrium fluoride ($YF_3$), lanthanum fluoride ($LaF_3$), cerium fluoride ($CeF_3$), neodymium fluoride ($NdF_3$), europium fluoride ($EuF_3$), dysprosium fluoride ($DyF_3$), or mixtures or combinations thereof, up to about 12% by weight of an anti-wear additive system, up to about 5% by weight of an anti-degradant system and from about 0.1% to about 5% by weight of one or more finely divided fibers selected from the group consisting of polyamide fibers, polyimide fibers, polyester fibers, polycarbonate fibers, carbon and carboneous fibers, and mixtures thereof and the natural fibers are selected from the group of cellulose fibers, modified cellulose fibers, and mixtures thereof.

2. The composition of claim 1, wherein metal fluoride is calcium fluoride ($CaF_2$).

3. The composition of claim 1, wherein the composition comprises:

about 58.10±10% by weight of a calcium sulfonate complex base grease, about 9.4±10% by weight of a calcium salt, about 30.00±10% by weight of a calcium fluoride, about 0.40±10% by weight of a tackifier, about 0.10±10% by weight of an $H_2S$ inhibitor, about 1.00±10% by weight of a hydrocarbon fiber, and about 1.00±10% by weight of a graphite/carbon.

4. The composition of claim 1, wherein the composition comprises:

about 42.45±10% by weight of a lithium sulfonate complex base grease, about 28.50±10% by weight of a calcium salt, about 15.00±10% by weight of a calcium fluoride, about 3.50±10% by weight of a PTFE, about 0.30±10% by weight of a tackifier, about 0.10±10% by weight of an $H_2S$ inhibitor, about 0.15±10% by weight of an aramid fiber, and about 10.00±10% by weight of a graphite/carbon.

5. The composition of claim 1, wherein the composition comprises: about 56.50±10% by weight of a metal complex base grease, about 18.00±10% by weight of a calcium salt, about 5.00±10% by weight of a calcium fluoride, about 7.00±10% by weight of a PTFE, about 0.50±10% by weight of an aramide fiber, and about 13.00±10% by weight of a graphite.

6. The composition of claim 1, wherein the composition comprises:

about 1.00±10% by weight of a hydrocarbon fiber, about 0.20±10% by weight of a carbon black, about 51.80±10% by weight of a sulfonate complex base grease, about 0.10±10% by weight of an $H_2S$ inhibitor, about 18.00±10% by weight of a calcium salt, about 3.50±10% by weight of a 5–100 Micron PTFE, about 20.00±10% by weight of a calcium fluoride, about 0.40±10% by weight of a tackifier, and about 5.00±10% by weight of a Graphite.

7. The composition of claim 1, wherein the composition comprises:

about 1.20±10% by weight of a hydrocarbon fiber, about 53.30±10% by weight of a sulfonate complex base grease, about 15.00±10% by weight of a calcium salt, about 20.00±10% by weight of a calcium fluoride, about 3.00±10% by weight of a 5 Micron PTFE, about 0.40±10% by weight of a tackifier, and about 0.10±10% by weight of an $H_2S$ Inhibitor.

8. An anti-seize thread composition comprising from about 40% to about 80% by weight of a thixotropic base material, from about 5% to about 40% by weight of one or more boundary lubricants, from about 5% to about 40% by weight of one or more metal fluorides, up to about 12% by weight of an anti-wear additive system and up to about 5% by weight of an anti-degradant system and from about 0.1% to about 5% by weight of one or more finely divided fibers.

9. The composition of claim 8, wherein:

the thixotropic base material is selected from the group consisting of a lithium complex grease, an aluminum complex grease, a calcium complex grease, and mixtures or combinations thereof;

the boundary lubricant is selected from the group consisting of a graphite, a graphitic type material, a silicate, a metal borate, metal acetate, metal carbonate, metal sulfate, and mixtures or combinations thereof; and the metal fluoride is selected from the group consisting of lithium fluoride (LiF), sodium fluoride (NaF), potassium fluoride (KF), rubidium fluoride (RbF), cesium fluoride (CsF), magnesium fluoride ($MgF_2$), calcium fluoride ($CaF_2$), strontium fluoride ($SrF_2$), yttrium fluoride ($YF_3$), lanthanum fluoride ($LaF_3$), cerium fluoride ($CeF_3$), neodymium fluoride ($NdF_3$), europium fluoride ($EuF_3$), dysprosium fluoride ($DyF_3$), or mixtures or combinations thereof.

10. The anti-seize compound of claim 9, wherein metal fluoride is calcium fluoride ($CaF_2$).

11. The composition of claim 9, wherein the composition comprises:

about 58.10±10% by weight of a calcium sulfonate complex base grease, about 9.4±10% by weight of a calcium salt, about 30.00±10% by weight of a calcium fluoride, about 0.40±10% by weight of a tackifier, about 0.10±10% by weight of an $H_2S$ inhibitor, about 1.00±10% by weight of a hydrocarbon fiber, and about 1.00±10% by weight of a graphite/carbon.

12. The composition of claim 9, wherein the composition comprises:

about 42.45±10% by weight of a lithium sulfonate complex base grease, about 28.50±10% by weight of a calcium salt, about 15.00±10% by weight of a calcium fluoride, about 3.50±10% by weight of a PTFE, about 0.30±10% by weight of a tackifier,
about 0.10±10% by weight of an $H_2S$ inhibitor,
about 0.15±10% by weight of an aramid fiber, and
about 10.00±10% by weight of a graphite/carbon.

13. The composition of claim 9, wherein the composition comprises:
about 56.50±10% by weight of a metal complex base grease,
about 18.00±10% by weight of a calcium salt,
about 5.00±10% by weight of a calcium fluoride,
about 7.00±10% by weight of a PTFE,
about 0.50±10% by weight of an aramide fiber, and
about 13.00±10% by weight of a graphite.

14. The composition of claim 9, wherein the composition comprises:
about 1.00±10% by weight of a hydrocarbon fiber,
about 0.20±10% by weight of a carbon black,
about 51.80±10% by weight of a sulfonate complex base grease,
about 0.10±10% by weight of an $H_2S$ inhibitor,
about 18.00±10% by weight of a calcium salt,
about 3.50±10% by weight of a 5–100 Micron PTFE,
about 20.00±10% by weight of a calcium fluoride,
about 0.40±10% by weight of a tackifier, and
about 5.00±10% by weight of a Graphite.

15. The composition of claim 9, wherein the composition comprises:
about 1.20±10% by weight of a hydrocarbon fiber,
about 53.30±10% by weight of a sulfonate complex base grease,
about 15.00±10% by weight of a calcium salt,
about 20.00±10% by weight of a calcium fluoride,
about 3.00±10% by weight of a Micron PTFE,
about 0.40±10% by weight of a tackifier, and
about 0.10±10% by weight of an $H_2S$ Inhibitor.

16. A method for protecting threaded connections comprising the steps of:
applying an amount of an anti-seize composition to surfaces of a speciality alloy threaded connections prior to make-up, where the composition comprises from about 40% to about 80% by weight of a thixotropic base material, from about 5% to about 40% by weight of one or more boundary lubricants, from about 5% to about 50% by weight of one or more metal fluorides, up to about 12% by weight of an anti-wear additive system and up to about 5% by weight of an anti-degradant system and from about 0.1% to about 5% by weight of one or more finely divided fibers and where the amount is sufficient to form an anti-seize film having sufficient strength to protect the alloy threaded connection from galling, and
making-up the threaded connection.

17. The method of claim 8, further comprising the step of:
applying and additional amount of the composition after each connection break-out, but prior a next make-up.

18. The method of claim 16, wherein:
the thixotropic base material is selected from the group consisting of a lithium complex grease, an aluminum complex grease, a calcium complex grease, and mixtures or combinations thereof;
the boundary lubricant is selected from the group consisting of a metal borate, metal acetate, metal carbonate, metal sulfate, and mixtures or combinations thereof; and
the metal fluoride is selected from the group consisting of lithium fluoride (LiF), sodium fluoride (NaF), potassium fluoride (KF), rubidium fluoride (RbF), cesium fluoride (CsF), magnesium fluoride ($MgF_2$), calcium fluoride ($CaF_2$), strontium fluoride ($SrF_2$), yttrium fluoride ($YF_3$), lanthanum fluoride ($LaF_3$), cerium fluoride ($CeF_3$), neodymium fluoride ($NdF_3$), europium fluoride ($EuF_3$), dysprosium fluoride ($DyF_3$), or mixtures or combinations thereof.

19. The method of claim 18, wherein metal fluoride is calcium fluoride ($CaF_2$).

20. The method of claim 16, further comprising an anti-wear additive system and an anti-degradant additive system and a synthetic fibers are selected from the group consisting of polyamide fibers, polyimide fibers, polyester fibers, polycarbonate fibers, carbon and carboneous fibers, and mixtures thereof and the natural fibers are selected from the group of cellulose fibers, modified cellulose fibers, and mixtures thereof.

21. The method of claim 20, wherein the composition comprises:
about 58.10±10% by weight of a calcium sulfonate complex base grease,
about 9.4±10% by weight of a calcium salt,
about 30.00±10% by weight of a calcium fluoride,
about 0.40±10% by weight of a tackifier,
about 0.10±10% by weight of an $H_2S$ inhibitor,
about 1.00±10% by weight of a hydrocarbon fiber, and
about 1.00±10% by weight of a graphite/carbon.

22. The method of claim 20, wherein the composition comprises:
about 42.45±10% by weight of a lithium sulfonate complex base grease,
about 28.50±10% by weight of a calcium salt,
about 15.00±10% by weight of a calcium fluoride,
about 3.50±10% by weight of a PTFE,
about 0.30±10% by weight of a tackifier,
about 0.10±10% by weight of an $H_2S$ inhibitor,
about 0.15±10% by weight of an aramid fiber, and
about 10.00±10% by weight of a graphite/carbon.

23. The method of claim 20, wherein the composition comprises:
about 56.50±10% by weight of a metal complex base grease,
about 18.00±10% by weight of a calcium salt,
about 5.00±10% by weight of a calcium fluoride,
about 7.00±10% by weight of a PTFE,
about 0.50±10% by weight of an aramide fiber, and
about 13.00±10% by weight of a graphite.

24. The method of claim 20, wherein the composition comprises:
about 1.00±10% by weight of a hydrocarbon fiber,
about 0.20±10% by weight of a carbon black,
about 51.80±10% by weight of a sulfonate complex base grease,
about 0.10±10% by weight of an $H_2S$ inhibitor,
about 18.00±10% by weight of a calcium salt,
about 3.50±10% by weight of a 5–100 Micron PTFE,
about 20.00±10% by weight of a calcium fluoride,
about 0.40±10% by weight of a tackifier, and
about 5.00±10% by weight of a Graphite.

25. The method of claim 20, wherein the composition comprises:
about 1.20±10% by weight of a hydrocarbon fiber,
about 53.30±10% by weight of a sulfonate complex base grease,
about 15.00±10% by weight of a calcium salt,
about 20.00±10% by weight of a calcium fluoride,
about 3.00±10% by weight of a 5 Micron PTFE,
about 0.40±10% by weight of a tackifier, and
about 0.10±10% by weight of an $H_2S$ Inhibitor.

* * * * *

US007091161C1

(12) EX PARTE REEXAMINATION CERTIFICATE (8912th)

United States Patent
Oldiges, Jr. et al.

(10) Number: US 7,091,161 C1
(45) Certificate Issued: Mar. 20, 2012

(54) NON-METALLIC THREAD SEALANT AND ANTI-SEIZE COMPOUND HAVING IMPROVED ANTI-GALLING PROPERTIES FOR METAL ALLOYS

(75) Inventors: Donald A. Oldiges, Jr., Crypress, TX (US); Herschel McDonald, Red Oak, TX (US); Tom Blake, Spring, TX (US); Kevin Stroup, Spring, TX (US); Don A. Oldiges, III, Crypress, TX (US)

(73) Assignee: Jet-Lube, Inc., Houston, TX (US)

Reexamination Request:
No. 90/011,511, Feb. 25, 2011

Reexamination Certificate for:

| | |
|---|---|
| Patent No.: | **7,091,161** |
| Issued: | **Aug. 15, 2006** |
| Appl. No.: | **10/438,301** |
| Filed: | **May 14, 2003** |

(51) Int. Cl.
*C10M 169/006* (2006.01)
*C10M 125/00* (2006.01)

(52) U.S. Cl. ..... 508/154; 508/113; 508/129; 508/156; 508/175; 508/219; 508/390; 508/181; 508/165; 508/130; 508/116

(58) Field of Classification Search ..... None
See application file for complete search history.

(56) References Cited

To view the complete listing of prior art documents cited during the proceeding for Reexamination Control Number 90/011,511, please refer to the USPTO's public Patent Application Information Retrieval (PAIR) system under the Display References tab.

*Primary Examiner*—Jerry D. Johnson

(57) ABSTRACT

An anti-seize compound is disclosed for use on surfaces of threaded connections made of speciality alloys such as high nickel or chrome ferrous alloys or other speciality alloys prone to galling under high stress conditions. The compound using a metal fluoride as the anti-seize film forming agent at least above about 5 wt %.

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-25 are cancelled.

* * * * *